US011156235B2

(12) United States Patent
Yang

(10) Patent No.: US 11,156,235 B2
(45) Date of Patent: Oct. 26, 2021

(54) THERMAL TRANSFERRING METHOD AND STRUCTURAL DEVICE UTILIZING THERMAL ENERGY BODY PERFORMING VIBRATION DISPLACEMENT (RELATIVE) TO FLUID

(76) Inventor: Tai-Her Yang, Dzan-Hwa (TW)

( * ) Notice: Subject to any disclaimer, the term of this patent is extended or adjusted under 35 U.S.C. 154(b) by 1813 days.

(21) Appl. No.: 13/541,830

(22) Filed: Jul. 5, 2012

(65) Prior Publication Data

US 2014/0008038 A1 Jan. 9, 2014

(51) Int. Cl.

| | |
|---|---|
| ***F04B 39/00*** | (2006.01) |
| ***F04F 7/00*** | (2006.01) |
| ***F04D 33/00*** | (2006.01) |
| ***F04B 43/04*** | (2006.01) |
| ***F04B 39/06*** | (2006.01) |
| ***F04B 45/047*** | (2006.01) |
| ***F04B 17/00*** | (2006.01) |
| ***F04B 53/08*** | (2006.01) |

(52) U.S. Cl.

CPC ..... *F04F 7/00* (2013.01); *F04B 17/003* (2013.01); *F04B 39/06* (2013.01); *F04B 43/043* (2013.01); *F04B 45/047* (2013.01); *F04B 53/08* (2013.01); *F04D 33/00* (2013.01)

(58) Field of Classification Search

CPC . F28D 15/00; F28F 3/046; F28F 13/10; F04F 7/00; H01L 41/08; H01L 23/473; H01L 23/44; F04D 33/00; F04B 39/00; F04B 39/06; F04B 43/043; F04B 45/047; F04B 53/08

USPC ..... 361/699

See application file for complete search history.

(56) References Cited

U.S. PATENT DOCUMENTS 5,008,582 A * 4/1991 Tanuma ..... H01L 23/467 257/E23.099

2002/0112496 A1* 8/2002 Bash ..... G06F 1/20 62/259.2

FOREIGN PATENT DOCUMENTS

JP 2000277959 A * 10/2000

JP 2006332377 A * 12/2006

* cited by examiner

*Primary Examiner* — Harry E Arant

(74) *Attorney, Agent, or Firm* — Bacon & Thomas, PLLC

(57) ABSTRACT

The present invention provides a thermal transferring method and a structural device utilizing thermal energy body performing vibration displacement to fluid in which a vibration actuating device is provided for performing vibration driving to a thermal energy body disposed in a fluid thereby allowing the thermal energy body to perform periodic vibration displacement to the fluid for transferring thermal energy and enabling the fluid to circulatively flow, thereby a novel thermal transferring method and a structural device utilizing thermal energy body performing vibration displacement to fluid for the purpose of heating or cooling are provided.

13 Claims, 1 Drawing Sheet

THERMAL TRANSFERRING METHOD AND STRUCTURAL DEVICE UTILIZING THERMAL ENERGY BODY PERFORMING VIBRATION DISPLACEMENT (RELATIVE) TO FLUID

BACKGROUND OF THE INVENTION (a) Field of the Invention

The present invention provides a thermal transferring method and a structural device utilizing thermal energy body performing vibration displacement to fluid in which a vibration actuating device is provided for performing vibration driving to a thermal energy body disposed in a fluid thereby allowing the thermal energy body to perform periodic vibration displacement to the fluid for transferring thermal energy and enabling the fluid to circulatively flow, thereby a novel thermal transferring method and a structural device utilizing thermal energy body performing vibration displacement to fluid for the purpose of heating or cooling are provided.

(b) Description of the Prior Art

A conventional thermal energy body disposed in a fluid for performing thermal transferring to the fluid for the purpose of heating or cooling often utilizes the fluid flowing through the thermal energy body for increasing the thermal transferring effect; however, a fluid pump has to be additionally provided for pumping the fluid to flow through the thermal energy body.

SUMMARY OF THE INVENTION

The present invention provides a thermal transferring method and a structural device utilizing thermal energy body performing vibration displacement to fluid in which a vibration actuating device is provided for performing vibration driving to a thermal energy body disposed in a fluid thereby allowing the thermal energy body to perform periodic vibration displacement to the fluid for transferring thermal energy and enabling the fluid to circulatively flow, thereby a novel thermal transferring method and a structural device utilizing thermal energy body performing vibration displacement to fluid for the purpose of heating or cooling are provided.

The structural device provided by the present invention includes utilizes an electric-driven vibration actuating device (200) which is connected to a thermal energy body (101) having relatively higher temperature and serving to perform vibration displacement to the ambient gaseous or liquid fluid having relatively lower temperature thereby forming a circulative flow and discharging the thermal energy having higher temperature to the thermal energy transferring fluid; or an electric energy driving device (300) is provided for driving the vibration actuating device (200), and the thermal energy body (101) connected with the vibration actuating device (200) and having relatively lower temperature is served to perform vibration displacement to the ambient gaseous or liquid fluid having relatively higher temperature thereby forming a circulative flow and absorbing the thermal energy having higher temperature of the thermal energy transferring fluid.

DESCRIPTION OF MAIN COMPONENT SYMBOLS

Figure 1:
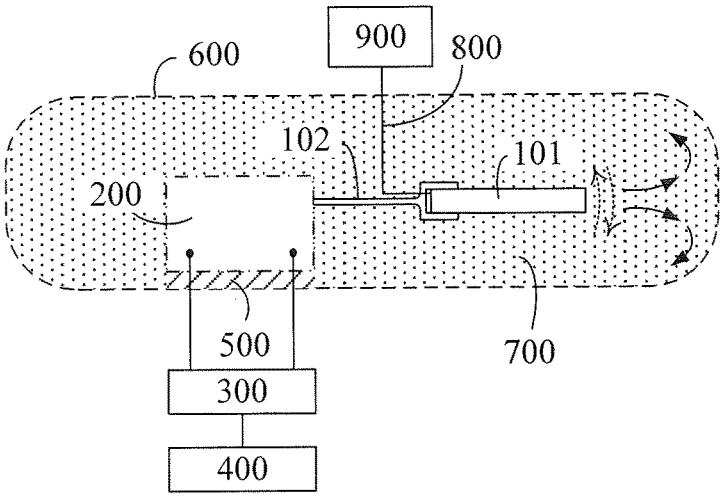
FIG. 1 is a schematic view showing the main structure of the present invention.

101: Thermal energy body
102: Vibration arm
200: Vibration actuating device
201: Magnetic conductive vibration reed
202: Magnetic conductive iron core
203: Excitation winding
2001: Lectromagnetic vibration device
2002: Solid state vibration device
300: Electric energy driving device
301: Deformation unit driven by electric energy
400: Driving electric energy source
500: Fixed base
600: Enclosure
700: Thermal energy transferring fluid
800: Soft electric conductive body
900: Electric energy transmission interface

DETAILED DESCRIPTION OF THE PREFERRED EMBODIMENTS

A conventional thermal energy body disposed in a fluid for performing thermal transferring to the fluid for the purpose of heating or cooling often utilizes the fluid flowing through the thermal energy body for increasing the thermal transferring effect; however, a fluid pump has to be additionally provided for pumping the fluid to flow through the thermal energy body.

The present invention provides a thermal transferring method and a structural device utilizing thermal energy body performing vibration displacement to fluid in which a vibration actuating device is provided for performing vibration driving to a thermal energy body disposed in a fluid thereby allowing the thermal energy body to perform periodic vibration displacement to the fluid for transferring thermal energy and enabling the fluid to circulatively flow, thereby a novel thermal transferring method and a structural device utilizing thermal energy body performing vibration displacement to fluid for the purpose of heating or cooling are provided.

The structural device provided by the present invention includes utilizing an electric-driven vibration actuating device (200) which is connected to a thermal energy body (101) having relatively higher temperature and serving to perform vibration displacement to the ambient gaseous or liquid fluid having relatively lower temperature thereby forming a circulative flow and discharging the thermal energy having higher temperature to the thermal energy transferring fluid; or an electric energy driving device (300) is provided for driving the vibration actuating device (200), and the thermal energy body (101) connected with the vibration actuating device (200) and having relatively lower temperature is served to perform vibration displacement to the ambient gaseous or liquid fluid having relatively higher temperature thereby forming a circulative flow and absorbing the thermal energy having higher temperature of the thermal energy transferring fluid.

FIG. 1 is a schematic view showing the main structure of the present invention.

As shown in FIG. 1, it mainly consists of:

thermal energy body (101): constituted by a thermal energy body having different temperature relative to the fluid, including being constituted by a thermal energy body (101) installed with an electric energy transmission interface (900) and a soft electric conductive body (800), wherein the soft electric conductive body (800), e.g. a soft electric conductive wire or soft electric conductive plate, is served to electrically connect the electric energy transmission interface (900) and the thermal energy body (101); the thermal energy body (101) includes a thermal energy body composed of analog or digital signal processing chips capable of inputting or outputting electric energy signals to the exterior, or semiconductor power units, or LED chips, or thermoelectric devices capable of converting thermal energy into electric energy, or semiconductors capable of being inputted with electric energy for cooling or heating, or a thermal energy body capable of converting chemical energy into thermal energy thereby utilizing the chemical energy for the purpose of cooling or heating;

vibration actuating device (200): constituted by a physical structural device capable of converting electric energy to perform vibration displacement, directly driven by the electric energy from a driving electric energy source (400) or driven by the electric energy outputted by an electric energy driving device (300) for generating the required vibration frequency and the vibration magnitude, thereby enabled to directly drive the thermal energy body (101) to perform vibration displacement for transferring thermal energy to the fluid and allowing the fluid to circulatively flow, or utilizing a vibration arm (102) extended from the vibration actuating device (200) to drive the connected thermal energy body (101) to perform vibration displacement thereby transferring thermal energy to the fluid and enabling the fluid to circulatively flow;

electric energy driving device (300): receiving the electric energy from the driving electric energy source (400) for generating the driving electric energy having corresponding voltage and output frequency to drive the vibration actuating device (200), and the electric energy driving device (300) includes being composed of an individual device or combined with the vibration actuating device (200);

fixed base (500): constituted by a fixed base for the installation of a housing or seat of the vibration actuating device (200);

enclosure (600): constituted by an accommodating structure for being installed with the vibration actuating device (200) and/or the extended vibration arm (102) and the thermal energy body (101); the internal space is filled with the thermal energy transferring fluid (700);

thermal energy transferring fluid (700): constituted by gaseous or liquid fluid or oil or paste fluid having viscosity, filled between the enclosure (600) and the vibration actuating device (200), the thermal energy body (101) and the vibration arm (102) for transferring thermal energy;

soft electric conductive body (800): constituted by a soft electric conductive wire or soft electric conductive plate installed between the thermal energy body (101) and the electric energy transmission interface (900) for transferring electric energy and/or signal electric energy;

electric energy transmission interface (900): constituted by an electric energy transmission interface device composed of electric conductive terminals or electric conductive wires or electric conductive plugs or sockets or connectors, served to transfer the electric energy of electric energy source and/or transfer the signal electric energy;

The mentioned thermal energy body (101), the vibration actuating device (200) and the electric energy driving device (300) are driven by the driving electric energy source (400), the driving electric energy source (400) includes AC or DC electric energy of the public electricity or an individual electric energy source for supplying the electric energy required by the thermal energy body (101), or directly supplying the electric energy required by the vibration actuating device (200) or driving the vibration actuating device (200) through the electric energy driving device (300).

Figure 2:
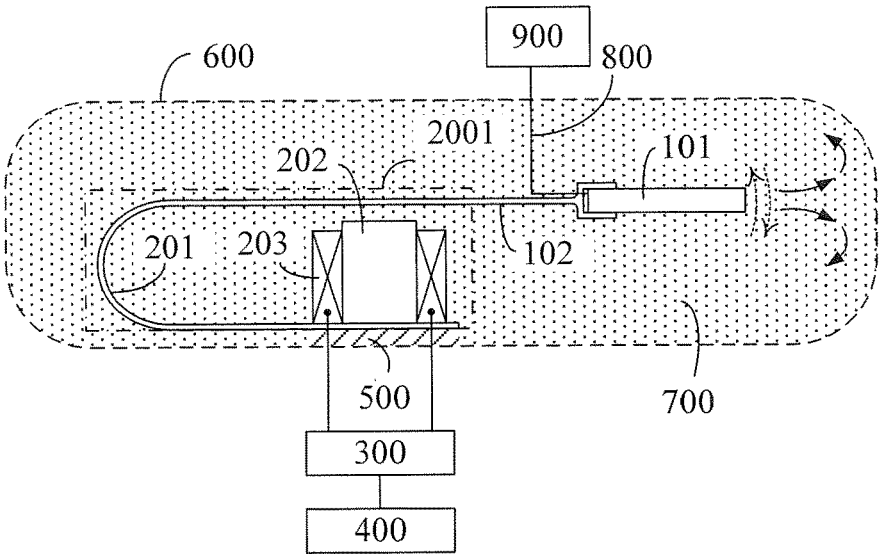
FIG. 2 is a schematic structural view illustrating an electromagnetic vibration device (2001) being adopted as the vibration actuating device (200) for driving the thermal energy body (101), according to the present invention.

FIG. 2 is a schematic structural view illustrating an electromagnetic vibration device (2001) being adopted as the vibration actuating device (200) for driving the thermal energy body (101), according to the present invention.

Figure 3:
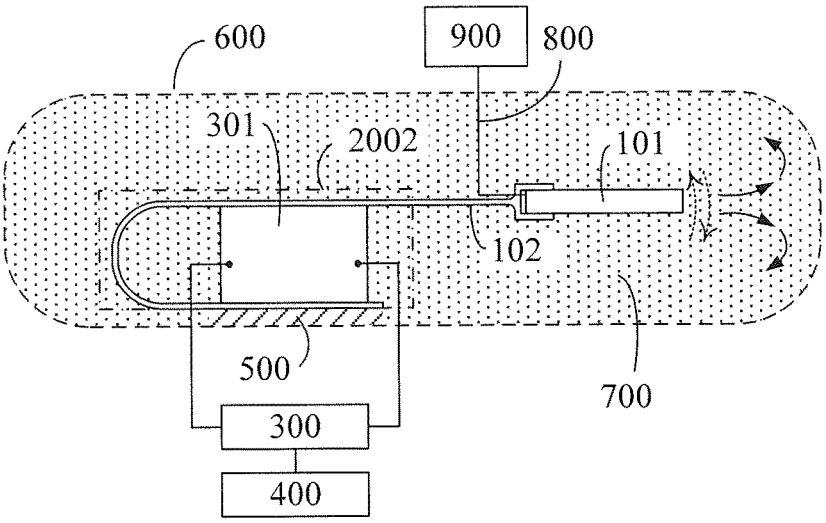
FIG. 3 is a schematic structural view illustrating a solid state vibration device (2002) being adopted as the vibration actuating device (200) for driving the thermal energy body (101), according to the present invention.

As shown in FIG. 2, it mainly consists of:

thermal energy body (101): constituted by a thermal energy body having different temperature relative to the fluid, including being constituted by a thermal energy body (101) installed with an electric energy transmission interface (900) and a soft electric conductive body (800), wherein the soft electric conductive body (800), e.g. a soft electric conductive wire or soft electric conductive plate, is served to electrically connect the electric energy transmission interface (900) and the thermal energy body (101); the thermal energy body (101) includes a thermal energy body composed of analog or digital signal processing chips capable of inputting or outputting electric energy signals to the exterior, or semiconductor power units, or LED chips, or thermoelectric devices capable of converting thermal energy into electric energy, or semiconductors capable of being inputted with electric energy for cooling or heating, or a thermal energy body capable of converting chemical energy into thermal energy thereby utilizing the chemical energy for the purpose of cooling or heating;

electromagnetic vibration device (2001): composed of a magnetic conductive vibration reed (201), a magnetic conductive iron core (202) and an excitation winding (203), directly driven by the electric energy from a driving electric energy source (400) or driven by the electric energy outputted by an electric energy driving device (300); after being electrically charged, the generated vibration displacement can be served to directly drive the thermal energy body (101) to perform vibration displacement for transferring thermal energy to the fluid and allowing the fluid to circulatively flow, or utilizing a vibration arm (102) extended from the magnetic conductive vibration reed (201) to drive the connected thermal energy body (101) to perform vibration displacement thereby transferring thermal energy to the fluid and enabling the fluid to circulatively flow;

electric energy driving device (300): receiving the electric energy from the driving electric energy source (400) for generating the driving electric energy having corresponding voltage and output frequency to drive the excitation winding (203) of the electromagnetic vibration device (2001), and the electric energy driving device (300) includes being composed of an individual device or combined with the electromagnetic vibration device (2001);

fixed base (500): constituted by a fixed base for the installation of a housing or seat of the electromagnetic vibration device (2001);

enclosure (600): constituted by an accommodating structure for being installed with the electromagnetic vibration device (2001) and/or the extended vibration arm (102) and the thermal energy body (101); the internal space is filled with the thermal energy transferring fluid (700);

thermal energy transferring fluid (700): constituted by gaseous or liquid fluid or oil or paste fluid having viscosity, filled between the enclosure (600) and the electromagnetic vibration device (2001), the thermal energy body (101) and the vibration arm (102) for transferring thermal energy;

soft electric conductive body (800): constituted by a soft electric conductive wire or soft electric conductive plate installed between the thermal energy body (101) and the electric energy transmission interface (900) for transferring electric energy and/or signal electric energy;

electric energy transmission interface (900): constituted by an electric energy transmission interface device composed of electric conductive terminals or electric conductive wires or electric conductive plugs or sockets or connectors, served to transfer the electric energy of electric energy source and/or transfer the signal electric energy;

FIG. 3 is a schematic structural view illustrating a solid state vibration device (2002) being adopted as the vibration actuating device (200) for driving the thermal energy body (101), according to the present invention.

As shown in FIG. 3, it mainly consists of:

thermal energy body (101): constituted by a thermal energy body having different temperature relative to the fluid, including being constituted by a thermal energy body (101) installed with an electric energy transmission interface (900) and a soft electric conductive body (800), wherein the soft electric conductive body (800), e.g. a soft electric conductive wire or soft electric conductive plate, is served to electrically connect the electric energy transmission interface (900) and the thermal energy body (101); the thermal energy body (101) includes a thermal energy body composed of analog or digital signal processing chips capable of inputting or outputting electric energy signals to the exterior, or semiconductor power units, or LED chips, or thermoelectric devices capable of converting thermal energy into electric energy, or semiconductors capable of being inputted with electric energy for cooling or heating, or a thermal energy body capable of converting chemical energy into thermal energy thereby utilizing the chemical energy for the purpose of cooling or heating;

solid state vibration device (2002): directly driven by the electric energy from a driving electric energy source (400) or driven by the electric energy outputted by an electric energy driving device (300), the solid state vibration device (2002) is composed by a deformation unit driven by electric energy (301) having the piezoelectric effect or hysteresis retraction effect; after being electrically charged, the generated vibration displacement can be served to directly drive the thermal energy body (101) to perform vibration displacement for transferring thermal energy to the fluid and allowing the fluid to circulatively flow, or utilizing a vibration arm (102) extended from the solid state vibration device (2002) to drive the connected thermal energy body (101) to perform vibration displacement thereby transferring thermal energy to the fluid and enabling the fluid to circulatively flow;

electric energy driving device (300): receiving the electric energy from the driving electric energy source (400) for generating the driving electric energy having corresponding voltage and output frequency to drive the solid state vibration device (2002), and the electric energy driving device (300) includes being composed of an individual device or combined with the solid state vibration device (2002);

fixed base (500): constituted by a fixed base for the installation of a housing or seat of the solid state vibration device (2002);

enclosure (600): constituted by an accommodating structure for being installed with the solid state vibration device (2002) and/or the extended vibration arm (102) and the thermal energy body (101); the internal space is filled with the thermal energy transferring fluid (700);

thermal energy transferring fluid (700): constituted by gaseous or liquid fluid or oil or paste fluid having viscosity, filled between the enclosure (600) and the solid state vibration device (2002), the thermal energy body (101) and the vibration arm (102) for transferring thermal energy;

soft electric conductive body (800): constituted by a soft electric conductive wire or soft electric conductive plate installed between the thermal energy body (101) and the electric energy transmission interface (900) for transferring electric energy and/or signal electric energy;

electric energy transmission interface (900): constituted by an electric energy transmission interface device composed of electric conductive terminals or electric conductive wires or electric conductive plugs or sockets or connectors, served to transfer the electric energy of electric energy source and/or transfer the signal electric energy.

According to the thermal transferring method and the structural device utilizing thermal energy body performing vibration displacement to fluid, the vibration frequency can be selected from one or more than one of the followings, which includes:

1. Frequency below the hearing range;
2. Frequency within the hearing range;
3. Frequency above the hearing range;
4. Variable working frequency.

The invention claimed is:

1. A thermal energy transfer device including an enclosure (600) filled with a thermal energy transferring fluid (700) and within which a thermal energy body (101) is situated, the thermal energy transferring fluid (700) surrounding and exchanging thermal energy with the thermal energy body (101) and the enclosure (600), comprising:

an energy transmission interface (900);

an electrically conductive body (800) that connects the energy transmission interface (900) to the thermal energy body (101), to electrically connect the energy transmission interface (900) and the thermal energy body (101);

a vibration actuating device (200, 2001, or 2002) fixed within the enclosure (600) and connected to the thermal energy body (101) by at least a connecting arm (102) extending at least from the vibration actuating device (200, 2001, 2002) to the thermal energy body (101) for causing-the thermal energy body (101) to vibrate relative to the thermal energy transferring fluid (700) in response to driving by the vibration actuating device (200, 2001, 2002) and thereby enhance the exchange of thermal energy between the thermal energy body (101), the thermal energy transferring fluid (700), and the enclosure (600) by causing circulative flow of the thermal energy transferring fluid (700) with respect to the thermal energy body;

an electric energy driving device (300) for supplying a driving electrical energy to the vibration actuating device (200), wherein the thermal energy transferring fluid (700) is one of a gaseous fluid, a liquid fluid, a viscous fluid, and an oil or paste based fluid.

2. The thermal energy transfer device of claim 1, wherein the thermal energy body (101) includes at least one of:

an analog or digital signal processing chip capable of inputting electrical signals from or outputting electrical signals through the energy transmission interface (900);

a semiconductor power unit that inputs and/or outputs electrical energy through the energy transmission interface (900);

an LED chip driven by electric energy input through the energy transmission interface (900);

a thermoelectric device arranged to convert thermal energy into electrical energy for output through the energy transmission interface (900);

a semiconductor heating or cooling device supplied with electrical energy through the energy transmission interface (900); and a chemical energy powered heating or cooling device.

3. The thermal energy transfer device of claim 1, wherein the electric energy driving device (300) is connected to a driving electric energy source (400), the electric energy driving device (300) converting energy supplied by the driving electric energy source (400) into electrical energy having a voltage and frequency adapted to drive the vibration actuating device (200, 2001, or 2002).

4. The thermal energy transfer device of claim 1, wherein the connecting arm (102) is a vibration arm (102) that extends from the vibration actuating device (200) and is coupled to the thermal energy body (101) to perform vibrating displacement of the thermal energy body (101).

5. The thermal energy transfer device of claim 1, wherein the vibration actuating device (200) includes a housing or seat mounted on a fixed base (500).

6. The thermal energy transfer device of claim 1, wherein the vibration actuating device is an electromagnetic vibration device (2001) that includes a magnetically conductive vibrating reed (201), a magnetically conductive core (202), and an excitation winding (203) supplied with the driving electrical energy to induce magnetic fluxes in the magnetically conductive core (202) and cause the vibrating reed (201) to responsively vibrate.

7. The thermal energy transfer device of claim 1, wherein the vibration actuating device is a solid state vibration device (2002) that deforms by a piezoelectric or hysteresis retraction effect when supplied with the driving electrical energy.

8. The thermal energy transfer device of claim 7, wherein a frequency of the vibrations is at least one of the following:

within a predetermined frequency range; and a variable working frequency.

9. The thermal energy transfer device of claim 6, wherein a frequency of the vibrations is at least one of the following:

within a predetermined frequency range; and a variable working frequency.

10. The thermal energy transfer device of claim 1, wherein a frequency of the vibrations is at least one of the following:

within a predetermined frequency range; and a variable working frequency.

11. A thermal energy transfer device including an enclosure (600) filled with a thermal energy transferring fluid (700) and within which a thermal energy body (101) is situated, the thermal energy transferring fluid (700) surrounding and exchanging thermal energy with the thermal energy body (101) and the enclosure (600), comprising:

an energy transmission interface (900);

an electrically conductive body (800) that connects the energy transmission interface (900) to the thermal energy body (101), to electrically connect the energy transmission interface (900) and the thermal energy body (101);

a vibration actuating device (200, 2001, or 2002) fixed within the enclosure (600) and connected to the thermal energy body (101) by at least a connecting arm (102) extending at least from the vibration actuating device (200, 2001, 2002) to the thermal energy body (101) for causing-the thermal energy body (101) to vibrate relative to the thermal energy transferring fluid (700) in response to driving by the vibration actuating device (200, 2001, 2002) and thereby enhance the exchange of thermal energy between the thermal energy body (101), the thermal energy transferring fluid (700), and the enclosure (600) by causing circulative flow of the thermal energy transferring fluid (700) with respect to the thermal energy body;

an electric energy driving device (300) for supplying a driving electrical energy to the vibration actuating device (200), wherein the electrically conductive body (800) is one of an electrically conductive wire and an electrically conductive plate.

12. A thermal energy transfer device including an enclosure (600) filled with a thermal energy transferring fluid (700) and within which a thermal energy body (101) is situated, the thermal energy transferring fluid (700) surrounding and exchanging thermal energy with the thermal energy body (101) and the enclosure (600), comprising:

an energy transmission interface (900);

an electrically conductive body (800) that connects the energy transmission interface (900) to the thermal energy body (101), to electrically connect the energy transmission interface (900) and the thermal energy body (101);

a vibration actuating device (200, 2001, or 2002) fixed within the enclosure (600) and connected to the thermal energy body (101) by at least a connecting arm (102) extending at least from the vibration actuating device (200, 2001, 2002) to the thermal energy body (101) for causing-the thermal energy body (101) to vibrate relative to the thermal energy transferring fluid (700) in response to driving by the vibration actuating device (200, 2001, 2002) and thereby enhance the exchange of thermal energy between the thermal energy body (101), the thermal energy transferring fluid (700), and the enclosure (600) by causing circulative flow of the thermal energy transferring fluid (700) with respect to the thermal energy body;

an electric energy driving device (300) for supplying a driving electrical energy to the vibration actuating device (200), wherein the energy transmission interface (900) includes at least one of an electrically conductive terminal, electric wire, and electrically conductive plug, socket, or connector.

13. A thermal energy transfer method, comprising the steps of:

providing an enclosure (600) filled with a thermal energy transferring fluid (700) and within which a thermal energy body (101) is situated, the thermal energy transferring fluid (700) surrounding and exchanging thermal energy with the thermal energy body (101), and the thermal energy body (101) being connected to an energy transmission interface (900) by an electrically conductive body (800);

supplying a driving electrical energy to a vibration actuating device (200, 2001, or 2002) connected to the thermal energy body (101) by a connecting arm (102) extending at least from the vibration actuating device (200, 2001, 2002) to the thermal energy body (101) to vibrate the thermal energy body (101) and thereby enhance the exchange of thermal energy between the thermal energy body (101), the thermal energy transferring fluid (700), and the enclosure (600) by causing circulative flow of the thermal energy transferring fluid (700) with respect to the thermal energy body.

* * * * *